US011738354B2

(12) United States Patent
Mann et al.

(10) Patent No.: US 11,738,354 B2
(45) Date of Patent: Aug. 29, 2023

(54) CENTRIFUGE WITH DRAINAGE

(71) Applicant: BlueCatBio GmbH, Neudrossenfeld (DE)

(72) Inventors: Wolfgang Mann, Neudrossenfeld (DE); Wolfgang Heimberg, Ebersberg (DE); Frank Feist, Concord, MA (US); Dong Liang, Bayreuth (DE)

(73) Assignee: BlueCatBio GmbH, Neudrossenfeld (DE)

( * ) Notice: Subject to any disclaimer, the term of this patent is extended or adjusted under 35 U.S.C. 154(b) by 786 days.

(21) Appl. No.: 16/624,749

(22) PCT Filed: Jun. 20, 2018

(86) PCT No.: PCT/EP2018/066495
§ 371 (c)(1),
(2) Date: Dec. 19, 2019

(87) PCT Pub. No.: WO2018/234420
PCT Pub. Date: Dec. 27, 2018

(65) Prior Publication Data

US 2021/0138485 A1 May 13, 2021

(30) Foreign Application Priority Data

Jun. 20, 2017 (DE) ..... 10 2017 113 583.9

(51) Int. Cl.
*B04B 5/04* (2006.01)
*B04B 7/02* (2006.01)
(Continued)

(52) U.S. Cl.
CPC ..... *B04B 5/0407* (2013.01); *B01L 13/02* (2019.08); *B04B 7/02* (2013.01); *B04B 7/04* (2013.01);
(Continued)

(58) Field of Classification Search
CPC ..... B04B 5/0407; B04B 7/02; B04B 15/06; B04B 7/04; B01L 13/02; B01L 2300/0829; B01L 3/5085; B01L 9/523
See application file for complete search history.

(56) References Cited

U.S. PATENT DOCUMENTS 4,221,325 A 9/1980 Kubota
4,953,575 A * 9/1990 Tervamaki ..... B01L 13/02 134/152
(Continued)

FOREIGN PATENT DOCUMENTS

CN 1533307 A 9/2004
CN 102175855 A 9/2011
(Continued)

OTHER PUBLICATIONS

International Preliminary Report on Patentability, dated Jan. 2, 2020, from International Application No. PCT/EP2018/066495, filed on Jun. 20, 2018. 26 pages.
(Continued)

*Primary Examiner* — Charles Cooley
(74) *Attorney, Agent, or Firm* — HoustonHogle LLP

(57) ABSTRACT

A centrifuge for cleaning a reaction vessel unit comprises a rotor and a rotor chamber in which the rotor is positioned and supported in rotary fashion. The rotor chamber is delimited by a housing having a drainage channel beneath the rotor. Adjacent to the channel, the inner surface of the housing is embodied in the form of a funnel that feeds into the channel. This centrifuge does not require a suction pump for suctioning liquids from the rotor chamber. In addition, the centrifuge can be provided with an exchangeable module that delimits the rotor chamber and includes the rotor. The exchangeable module can be exchanged after a predetermined amount of use and replaced with another. It is also
(Continued)

possible, however, for the module to be removed from the centrifuge, cleaned, and reinserted.

17 Claims, 5 Drawing Sheets

(51) Int. Cl.
*B04B 15/06* (2006.01)
*B04B 7/04* (2006.01)

(52) U.S. Cl.
CPC ..... *B04B 15/06* (2013.01); *B01L 2300/0829* (2013.01)

(56) References Cited

U.S. PATENT DOCUMENTS

| | | | | |
|---|---|---|---|---|
| 5,322,497 | A * | 6/1994 | Kobayashi | B04B 5/0421 494/20 |
| 11,117,142 | B2 * | 9/2021 | Mann | B04B 11/04 |
| 2004/0087426 | A1 * | 5/2004 | Lattanzi | G01N 35/04 494/20 |
| 2007/0037684 | A1 | 2/2007 | Moscone, Sr. et al. | |
| 2019/0022670 | A1 * | 1/2019 | Mann | B04B 11/04 |
| 2021/0138485 | A1 * | 5/2021 | Mann | B04B 7/02 |
| 2023/0077651 | A1 * | 3/2023 | Mann | B04B 5/0407 |

FOREIGN PATENT DOCUMENTS

| | | | |
|---|---|---|---|
| CN | 105517711 | A | 4/2016 |
| CN | 106573255 | A | 4/2017 |
| DE | 1033446 | | 7/1958 |
| DE | 24 04 036 | | 7/1975 |
| DE | 3932456 | | 4/1990 |
| DE | 10135317 | | 1/2003 |
| DE | 103 55 179 | A1 | 6/2005 |
| DE | 60029313 | | 7/2007 |
| DE | 10 2008 042 971 | A1 | 4/2010 |
| DE | 10 2016 101 163 | | 7/2017 |
| EP | 0 937 502 | A2 | 8/1999 |
| EP | 1270078 | | 2/2003 |
| EP | 2 705 903 | A1 | 3/2014 |
| JP | 2009264927 | A | 11/2009 |
| WO | WO 2013160668 | | 10/2013 |
| WO | WO 2015018878 | | 2/2015 |
| WO | WO 2016192927 | A1 | 12/2016 |
| WO | WO 2016052265 | | 4/2017 |
| WO | WO 2017125598 | | 7/2017 |

OTHER PUBLICATIONS

German Search Report dated Nov. 5, 2018, from German Patent Application No. 10 2017 113 583.9, filed on Jun. 20, 2017. 9 pages.
International Search Report and Written Opinion of the International Searching Authority, dated Nov. 23, 2018, from International Application No. PCT/EP2018/066495, filed on Jun. 20, 2018. 23 pages.

* cited by examiner

CENTRIFUGE WITH DRAINAGE

RELATED APPLICATIONS

This application is a § 371 National Phase Application of International Application No. PCT/EP2018/066495, filed on Jun. 20, 2018, now International Publication No. WO 2018/234420, published on Dec. 27, 2018, which International Application claims priority to German Application 10 2017 113 583.9, filed on Jun. 20, 2017, both of which are incorporated herein by reference in their entirety.

BACKGROUND OF THE INVENTION

The present invention relates to a centrifuge for cleaning a reaction vessel unit, comprising a rotor and a rotor chamber in which the rotor is positioned and supported in rotary fashion, the rotor having a receiving region for receiving the reaction vessel unit.

EP 937502 A2 describes a method for handling a microtiter plate in which the microtiter plate is cleaned by means of centrifugation. To accomplish this, the microtiter plate is placed in the rotation housing by a conveyor belt so that the openings of the microtiter plate are oriented away from the rotation axis.

WO 2015/018878 A1 shows another centrifuge that has an elastic arm with which microtiter plates can be pulled into a rotor of the centrifuge and be slid out from this rotor. In this case, the rotor is spaced only a very small distance apart from the surrounding housing and also from the drainage channel situated in the lower region. This short interval is intended so that the resulting circulation wind drives liquid, which has exited the reaction vessels, into the drainage channel from which it is then pumped out by means of a pump. Due to the small distance, there is a risk of the liquid level being higher than the drainage channel. As a result, the rotor can dip into the liquid as it rotates. This is particularly critical when the liquid is a washing solution of detergents since the rotor then beats the liquid into foam. This foam can quickly fill a large part of the volume of the rotor and can leak out at the door. Furthermore, the foaming material cannot be effectively pumped out by the above-described pump, instead remaining in the rotor chamber and in the drainage channel. The close spacing of the rotor from the drainage channel is primarily due to the cylindrical shape of the rotor chamber, which is selected in such a way as to generate the desired circulation wind.

It is known that with cylindrical rotor chambers of centrifuges, circulation winds are produced by the rotating rotor. In this connection, reference is made to US 2007/0037684 A1, DE 103 55 179 A1, DBP 1033446, EP 2 705 903 A1, and DE 2404036.

DE 10 2008 042 971 A1 discloses a centrifuge into which a magnet device is integrated in order to thus keep magnetizable particles inside a reaction vessel by means of magnetic force.

CN 102175855 A discloses a fully automated 360° plate washer. The rotational axis of this washer extends parallel to the horizontal plane and thus allows a plurality of plates to be washed at the same time in a housing, thus making it possible to increase effectiveness and reduce costs.

U.S. Pat. No. 4,953,575 relates to a washing device for cuvettes. For this purpose, the cuvettes are placed in a holder in a rotor. Through rotation of the rotor, the liquid is removed from the cuvettes. The disclosed centrifuge housing has an opening at its lowest point, through which the removed liquid can exit the housing.

JP 2009264927 A discloses an apparatus including a drum in which a microplate can be placed. The drum can be loaded with a plurality of microtiter plates, which then rotate around a horizontal rotation axis. The microtiter plate is loaded into the drum in such a way that its openings are oriented in the direction of the inside of the drum.

SUMMARY OF THE INVENTION

The problem underlying the invention is to produce a centrifuge for cleaning a reaction vessel unit, which has a rotor and a rotor chamber in which the rotor is supported in rotary fashion so that the design of the centrifuge is simpler than in the conventional centrifuges described at the beginning and a more reliable operation is possible.

Another problem underlying the present invention, in a centrifuge described at the beginning for cleaning a reaction vessel unit, is to modify the centrifuge so that the risk of contamination of the reaction vessel units is reduced.

Basically, the problem underlying the present invention is to produce a centrifuge for cleaning a reaction vessel unit, which should enable a rapid, thorough, and reliable cleaning.

One or more of the above-mentioned problems are solved by the subjects of the independent claims. Advantageous embodiments are disclosed in the respective dependent claims.

According to a first aspect of the present invention, a centrifuge for cleaning a reaction vessel unit is provided, which has a rotor and a rotor chamber in which the rotor is positioned and supported in rotary fashion. The rotor has a receiving region for receiving the reaction vessel unit. The rotor chamber is delimited by a housing.

The centrifuge features the fact that below the rotor, the housing has a drainage channel and the inner surfaces of the housing adjacent to the channel form a funnel that feeds into the channel.

Because of the provision of the funnel below the rotor, liquids that have been centrifuged out of the reaction vessel unit are collected in the channel so that they can drain out of the channel.

It has surprisingly turned out that a suction pump is not needed for draining liquids from the centrifuge. Instead, the wind that is generated by the rotation of the rotor and the shape of the funnel are sufficient to cause the liquids to reliably collect in the channel and be drained away. A centrifuge of this kind can therefore be operated without a suction pump. It is also advantageous to operate the centrifuge without a suction pump because if the suction pump fails, it constitutes a flow resistance that makes it impossible to continue operating the centrifuge since at that point, the liquid can no longer be removed from the centrifuge. The omission of the suction pump also constitutes a significant simplification and reduction in costs. The use of a centrifuge with a suction pump also requires the control unit of the centrifuge to be connected to the suction pump, which entails an additional technical cost.

All of this can be eliminated through the clever design of the housing, thus making the operation of the centrifuge even more reliable since the removal of the liquid from the rotor chamber cannot be impaired by a failure of a suction pump.

In addition, by omitting the suction pump, the flow path from the centrifuge housing to a catch basin can be shortened significantly and embodied much more simply. It is easily accessible during maintenance work.

The inner surfaces of the housing that form the funnel have a curvature that is much larger than the curvature of a cylindrical surface along which the outer edges of a rotor travel during rotation. The curvature radius of the inner surfaces that form the funnel is preferably at least 0.5 m, in particular at least 1 m, and is preferably infinite, i.e. the inner surfaces that form the funnel are planar.

The inner surfaces that form the funnel, which are referred to below as the funnel surfaces, preferably extend from the channel laterally to the outer edge of a rotation volume of the rotor, i.e. when viewed from above, the funnel and the channel cover the entire vertical projection of the rotor. In other words, this means that in any arbitrary position, even a horizontal one, the rotor does not extend beyond the lateral edge of the funnel.

Such an embodiment of the funnel surfaces with a slight curvature has the effect that with a rotation of the rotor, the latter comes the closest to the funnel surface in a middle region and is spaced a greater distance apart from both the outer edge and the middle edge, which is positioned adjacent to the channel. In these regions that are spaced a greater distance from the rotor, when the rotor rotates, there is less air flow so that the liquids collect there and drain out along the funnel surface.

The distance of the channel from a rotation axis around which the rotor rotates is preferably at least 1.1 times the maximum radius of the rotor and in particular, at least 1.2 times or 1.3 times the maximum radius of the rotor. This distance is measured from the upper edge of the channel to the rotation axis. This distance from the rotation axis, which is slightly greater than the radius of the rotor, produces a free space in the funnel in which liquid can temporarily collect. If a reaction vessel unit with high-volume reaction vessels that are almost completely filled is being cleaned, then with a first rotation or the first rotations of the rotor, most of the liquid contained in the reaction vessels is emptied out all at once. This liquid can collect in the free space without coming into contact with the rotating rotor. The liquid can then drain out of this free space gradually via the channel.

The inner surface of the housing, at least in the region of the funnel and the channel, is preferably coated with a smooth layer. This layer can be a hydrophobic layer, which is advantageous for draining off an aqueous solution. For example, this layer can be made of PTFE (polytetrafluorethylene).

The rotation axis of the rotor is preferably positioned parallel to a support surface of the housing. As a result of this, the rotation axis of the rotor is positioned horizontally during operation. Such a positioning of the rotation axis makes it easy to load a reaction vessel unit into the centrifuge, since when the vessel is inserted, it can be inserted into the rotor chamber with the openings of the reaction vessels facing upward. In reaction vessel units with high-volume reaction vessels (e.g. microtiter plates with 96 reaction vessels), the liquid does not necessarily adhere completely due to capillary forces in reaction vessels. With a horizontal positioning of the rotation axis, such reaction vessel units, after having been inserted into the rotor chamber or into the rotor, can be turned over by rotating the rotor by 180° so that their openings point downward toward the funnel. Most of the liquid then drains out of the reaction vessel units and drips directly into the funnel. The remaining quantities of liquids adhering in the reaction vessels due to surface tension can then be centrifuged out by centrifuging.

The channel is preferably inclined relative to the support surface of the housing. At the lower end of the channel, it feeds into an outlet opening of the housing. This outlet opening can have a hose connected to it, which conveys the liquid into a container. This arrangement should be embodied so that no back pressure is produced as the liquid is drained out. This can be achieved, for example, by providing a ventilation opening in the container.

It can also be advantageous for the housing to have a ventilation opening that feeds into the rotor chamber. If the rotor chamber is otherwise essentially airtight, then if the liquid completely fills the cross-section of the outlet opening as it is draining out, this can generate a negative pressure in the rotor chamber, which would counteract further drainage of the liquid. This is prevented by providing a ventilation opening. A filter such as an activated charcoal filter is provided in the ventilation opening, which prevents outside germs from getting into the rotor chamber. Such a ventilation opening is preferably provided in the vicinity of an end wall of the housing that is not directly sprayed with liquid from the reaction vessel unit during the centrifuging. The ventilation opening can also be screened off from the rotor chamber with a screen, said screen being positioned spaced apart from the ventilation opening.

Such a centrifuge has a housing with an opening for both inserting a reaction vessel unit into the rotor chamber and removing it from there. This opening can be closed by means of a door, which is typically automatically actuated. If this door is not perfectly sealed, then it constitutes a ventilation opening in the closed state. Preferably, the door is provided with a filter element positioned at its closing edges so that the air flowing in at the edges of the door must pass through the filter.

According to another aspect of the present invention, a centrifuge for cleaning a reaction vessel unit is provided, which has a rotor and a rotor chamber in which the rotor is positioned and supported in rotary fashion. The rotor has a receiving region for receiving a reaction vessel unit. The centrifuge is provided with a housing, which delimits the rotor chamber. In addition, the centrifuge has a drive unit for rotating the rotor. The centrifuge is embodied with an exchangeable module, which includes the rotor and a housing section of the housing, this housing section encompassing the rotor.

The exchangeable module is embodied so that it can be detached from the rest of the parts of the centrifuge.

This makes it possible, after a single use or multiple use of a centrifuge equipped with such an exchangeable module, to remove the exchangeable module from the rest of the parts of the centrifuge and to clean it and/or to replace it with another exchangeable module. This exchangeable module preferably includes only mechanical elements such as the rotor, housing, bearings, etc. and no electronic elements. This makes it possible to autoclave the exchangeable module and thus to clean and sterilize it so that it is free of residue.

Basically, a centrifuge of this kind can be cleaned by introducing a cleaning agent, which is poured for example into the reaction vessel of a reaction vessel unit and then centrifuged in the centrifuge or is introduced by means of corresponding nozzles in the rotor chamber. Such a cleaning, however, is not always completely residue-free.

An exchangeable module comprises few mechanical parts, which in terms of the centrifuge as a whole, only make up a small part of the production costs. Such a centrifuge has a drive for rotating the rotor, a control unit for controlling the rotary motion of the centrifuge, and other components such as a dispensing device and/or a loading and unloading device. Such a loading and unloading device can be relatively complex, particularly if it is embodied with a detection device for determining the position of a displacing rod of the loading and unloading device. By exchanging the exchangeable module, it is thus possible to exchange only an inexpensive component of the centrifuge and to continue using the rest of the components unchanged. This exchangeable module can therefore be a consumable, which is used only one time or is used for a predetermined period of time or for a predetermined number of cleaning procedures. If the exchangeable module is provided as a consumable, then it can also be advantageous for parts of it to be made of plastic, particularly in the form of injection-molded plastic articles, for example the rotor and/or the housing section of the exchangeable module. On the other hand, the exchangeable module can also be embodied as heat-resistant so that it is able to reliably withstand temperatures of up to 100° C. and preferably up to 150° C. so that the exchangeable module can be cleaned by means of an autoclaving procedure. Because the exchangeable module can be detached from the electronic components of the centrifuge, it is possible to embody the exchangeable module as heat-resistant. This enables a residue-free cleaning and reuse of the exchangeable module.

Such an exchangeable module preferably has a fastening mechanism with which it can be simply and quickly coupled to the rest of the parts of the centrifuge, fixed in position, and coupled to the remaining functional elements such as the drive unit, pipetting unit, camera, and/or loading and unloading device in such a way that the function of these elements can be performed.

The centrifuge according to one of the above-explained embodiments can be provided with a loading and unloading device, which includes a rigid displacing rod for positioning a reaction vessel unit in the rotor or for removing a reaction vessel unit from it. The displacing rod is positioned in a movable fashion in such a way that it can be moved between an unloading position, in which it extends through the rotor in the rotor chamber, and a loading position, in which it is retracted at least from the region of the rotor chamber that is occupied by the rotor during a rotation. A linear drive can be provided for moving the displacing rod between the unloading position and the loading position.

At a free end of the displacing rod positioned in the rotor chamber, a coupling element can be provided. The coupling element serves to produce a reconnectable connection of the displacing rod to a reaction vessel unit or to a supporting device for a reaction vessel unit.

The coupling element can have a detent element, which can engage with a counterpart detent element provided on the reaction vessel unit or on the supporting device, with at least the detent element or the counterpart detent element being elastically supported.

The counterpart detent element of the reaction vessel unit or supporting device can be elastically supported and coupled to a locking clip so that the locking clip can be pivoted between two positions; an unlocked position is assumed when the detent element and the counterpart detent element are detent-engaged with each other and a locked position is assumed when the detent element and the counterpart detent element are separated from each other, with the locking clip having a locking element that can engage with a corresponding counterpart locking element in a locked position.

The displacing rod preferably has a smooth surface.

The displacing rod can be hollow and can be embodied as open at the back end oriented away from the rotor chamber and a threaded rod can be provided coaxial to the displacing rod. The threaded rod can engage in meshing fashion with a thread connected to the displacing rod so that a rotating motion of the threaded rod causes a translatory motion of the displacing rod to be executed. The threaded rod in this case plunges into the back end of the displacing rod. The displacing rod can be guided through an opening in a housing wall, with a sealing element being provided in the vicinity of the opening, which seals the displacing rod against the housing wall. If an exchangeable module is provided, then preferably an additional housing wall is provided, which is not a component of the exchangeable module and in which the opening is embodied with a sealing ring. Another sealing element can be provided in a corresponding opening of the housing wall of the exchangeable module.

A detection device for determining the position of a displacing rod can be provided. This detection device is preferably an optical detection device.

The centrifuge can have a pipetting and dispensing unit, the dispensing unit preferably being equipped with a plurality of pipetting and dispensing nozzles. The dispensing nozzles are preferably situated one after another along a line, this line extending perpendicular to the movement direction of the reaction vessel unit during the loading or unloading. The nozzles of the dispensing unit are preferably positioned adjacent to an opening for the loading and unloading of the centrifuge with the reaction vessel unit.

Furthermore, an optical detection unit can be provided, which is positioned adjacent to the rotor chamber in the movement range of the reaction vessel unit in order to scan the latter. For example, this detection unit includes a line scan camera in order to perform a line scan of a reaction vessel unit, a scan line being oriented approximately perpendicular to the movement direction of the reaction vessel unit.

The detection unit can have a color camera in order to spectrally scan a reaction vessel unit. The optical detection unit can also be used for 3D scanning.

The centrifuge can have an evaluation device with which the signals received with the optical detection device are automatically evaluated according to one or more of the following parameters:

- color of the contents of at least one reaction vessel of the reaction vessel unit,
- fill level of at least one reaction vessel of the reaction vessel unit,
- position of the reaction vessel unit,
- type of reaction vessel unit.

A spray device for spraying a decontamination solution or cleaning solution into the interior can be provided in the rotor chamber.

The housing can be provided with one or more windows in the vicinity of the rotor chamber.

The centrifuge can have a control unit, which detects the position of a reaction vessel unit or the position of a support of a reaction vessel unit and transmits this via an interface to another device such as a robot or another component in the centrifuge, for example a dispensing unit, so that the other device or other component can receive the position of the reaction vessel unit or the support of the reaction vessel unit.

Some of the above-explained components are described and shown in DE 10 2016 101 163 and in the international patent application PCT/EP 2017/051289, which is the reason why reference is also made to these documents in their entirety.

The above-explained aspects, components, and parts of a centrifuge can basically be freely combined with one another at will.

According to another aspect of the present invention, a method is provided for cleaning a reaction vessel unit having a centrifuge with a rotor. The reaction vessel unit is placed in the rotor with the openings of the reaction vessels pointing radially outward. The rotor is rotated together with the reaction vessel unit around a rotation axis so that the contents of the reaction vessels are centrifuged out. Solely due to the rotary motion of the rotor and the force of gravity, the contents of the reaction vessels are driven into the channel and from there toward the outside. In this case, a suction pump is not used for aspirating the liquid from the rotor chamber.

According to another aspect of the present invention, a method is provided for cleaning a reaction vessel unit having a centrifuge with a rotor in which the reaction vessel unit is positioned in the rotor with the openings of the reaction vessels oriented radially outward. The rotor is rotated together with the reaction vessel unit around a rotation axis so that the contents of the reaction vessels are centrifuged out. After the cleaning of one or more reaction vessel units, an exchangeable module that includes a housing section and the rotor is separated from the remaining part of the centrifuge and is either cleaned or replaced with another exchangeable module.

A centrifuge of the kind explained above can be used in this method.

The invention will be explained in greater detail below by way of example based on the drawings.

DESCRIPTION OF THE PREFERRED EMBODIMENT(S)

Figure 1:
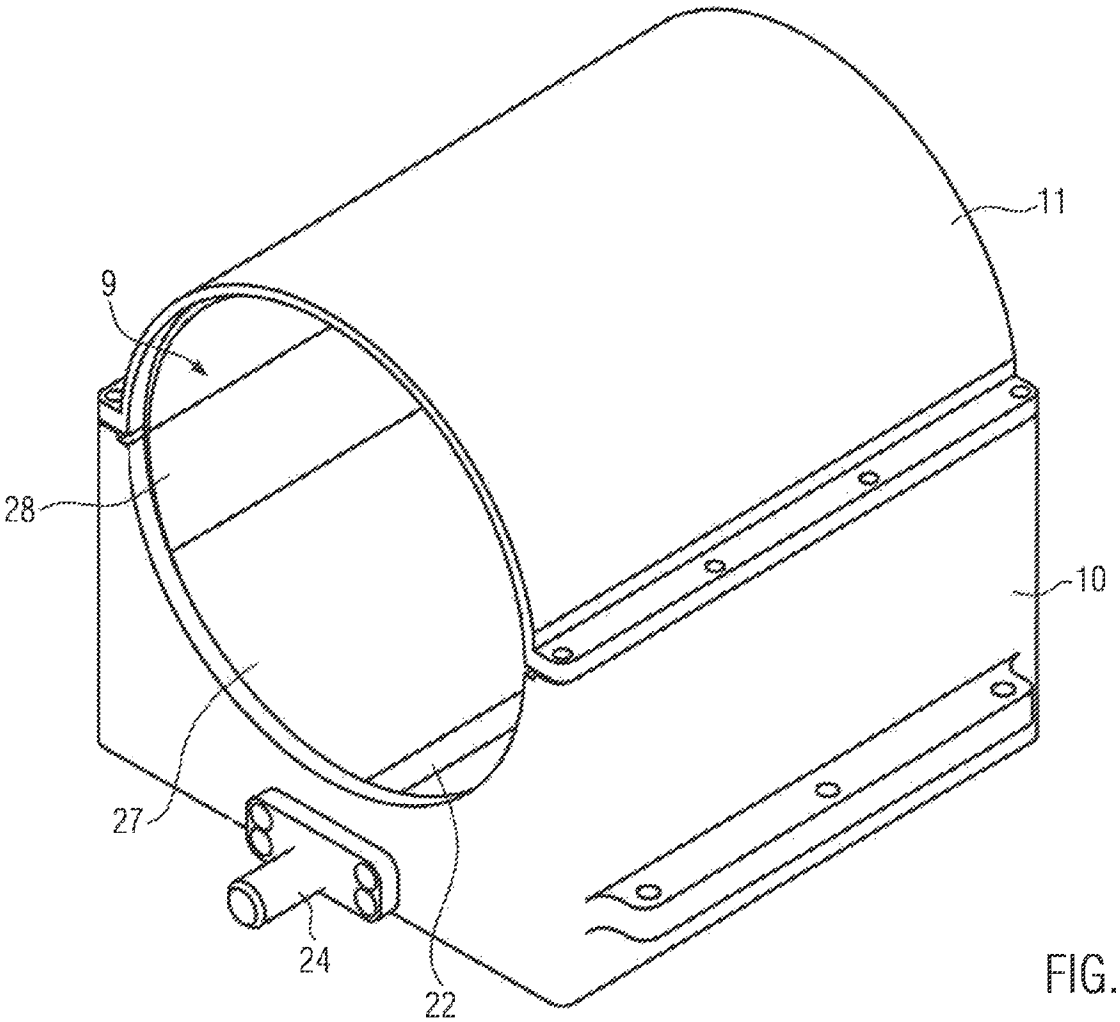
FIG. 1 shows a perspective view of a part of a housing of a centrifuge.

A centrifuge 1 according to the invention (FIG. 4) has a rotor 2, a housing 3, and a drive unit 4 for rotating the rotor 2 around a rotation axis 5.

The rotor has at least one receiving region 6 for receiving a reaction vessel unit 7. The reaction vessel unit 7 is usually a microtiter plate. Such microtiter plates can be embodied with a different number of reaction vessels. It is typical for microtiter plates to have from 6 to 4096 reaction vessels; microtiter plates with 96, 384, or 1536 reaction vessels are the most common versions. In microtiter plates with 384 or 1536 reaction vessels, the individual reaction vessels are so thin that a liquid normally adheres to the inside of them based solely on capillary forces so that even when such a microtiter plate is placed with its openings facing downward, the liquid does not drain out. For microtiter plates with fewer reaction vessels, each of which is larger, this is not the case. Such a reaction vessel unit 7 can only be inserted into a receiving device 6 or placed on a supporting device. Preferably, a supporting device is used, which has a coupling element that can be coupled to a loading and unloading device 8. Such a loading and unloading device is described, for example, in DE 10 2016 101 163. It is explained in greater detail below.

The housing 3 delimits a rotor chamber 9. In the present exemplary embodiment, the region of the housing 3 delimiting the rotor chamber 9 is composed of a lower shell 10, upper shell 11, front end wall 12, and back end wall 13. The back end wall is adjoined by other parts of the housing, which are not shown in the attached figures.

The front end wall 12 and back end wall 13 each have a ball bearing 14 in which a continuous shaft 15 of the rotor 2 is supported in rotary fashion. The center line of the shaft 15 constitutes the rotation axis 5. The rotation axis 5 extends parallel to a support surface 16, which is embodied by the underside of the lower shell 10.

The back end of the shaft 15 is coupled to the drive unit 4. The other part of the housing, which adjoins the back of the housing, contains the drive unit 17, the loading and unloading device 8, and a central control unit (not shown), which controls all of the components of the centrifuge 1.

At the front end wall 12, a ledge 18 is mounted on the outside, which is for accommodating a reaction vessel unit 7. At the level of the ledge 18, the front end wall 12 is provided with a loading and unloading opening 19 through which a reaction vessel unit 7 is inserted into the rotor chamber 9 and can be slid back out again. The loading and unloading opening 19 is provided with a pivoting door 20 so that the rotor chamber can be closed.

Adjacent to this door 20, a dispenser unit can be provided, which has a plurality of dispenser nozzles and/or an optical detection unit, particularly in the form of a line scan camera.

The loading and unloading device 8 has a displacing rod (not shown), which can be moved with its free end horizontally through the rotor chamber 9 through opening 21 in the back end wall 13. For this purpose, the loading and unloading device 8 has a linear drive unit so that the displacing rod can be moved in linear fashion along its longitudinal direction. The free end of the displacing rod has a coupling element, which can be coupled to an appropriate coupling element on the supporting device or a reaction vessel unit 7 so that the supporting device can be moved with a reaction vessel unit or the reaction vessel unit directly by moving the displacing rod from the ledge 18 through the loading and unloading opening 19 and into the rotor chamber 9, in this case, the rotor 2 being positioned with a receiving region 6 adjacent to the loading and unloading opening 19 so that the supporting device or the reaction vessel unit is slid into the receiving region 6 of the rotor 2. The coupling between the displacing rod and the supporting device or reaction vessel unit 7 can be detached so that the supporting device or reaction vessel unit is able to move freely in the rotor 2 and the rotor can be correspondingly rotated with this unit.

By means of the displacing rod of the loading and unloading device 8, the supporting device or reaction vessel unit 7 can be slid out of the receiving region 6 of the rotor 2 by means of the loading and unloading opening 19 and back onto the ledge 18. On the ledge 18, the reaction vessel unit 7 can be removed, for example by means of a robot.

Figure 4:
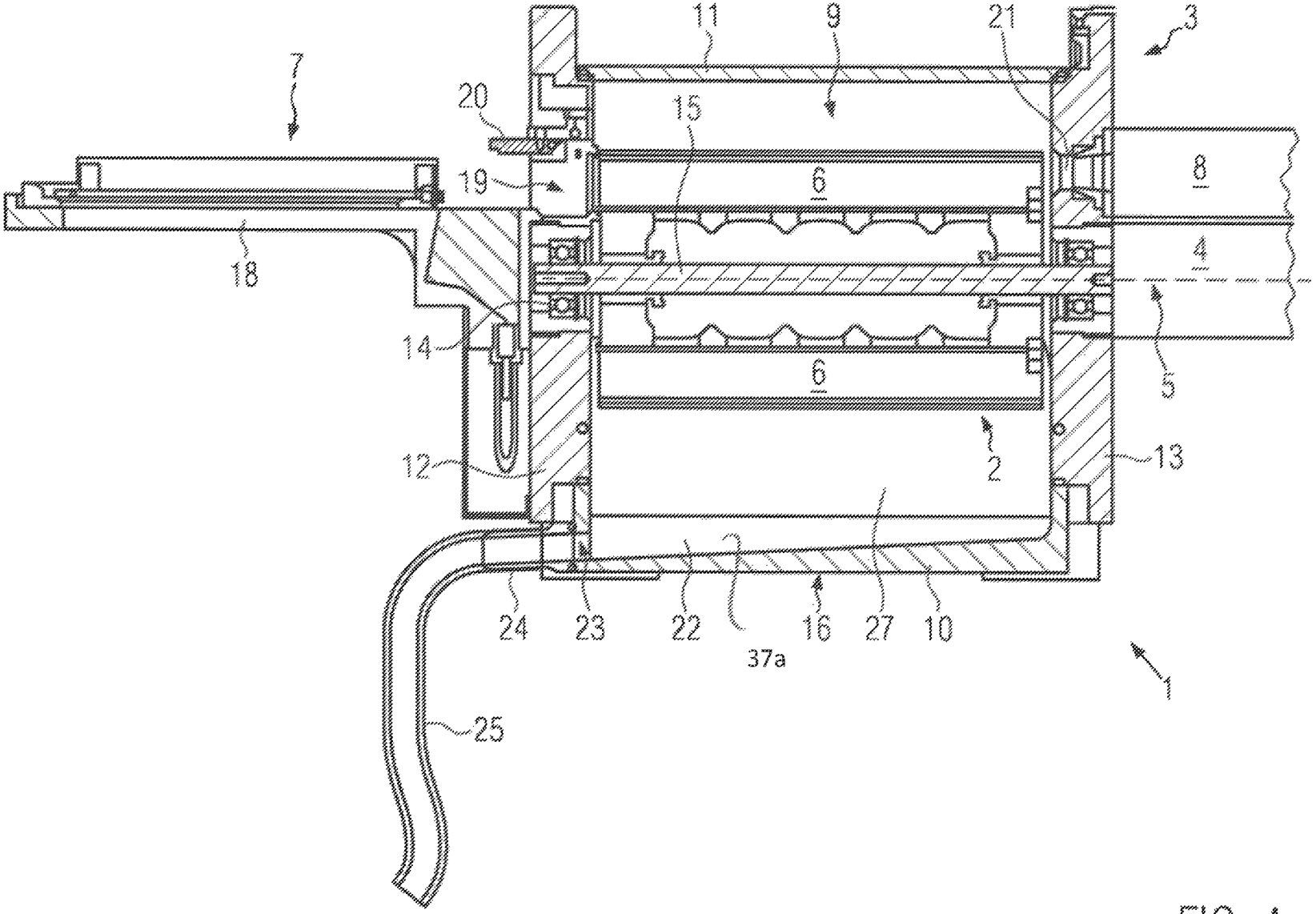
FIG. 4 shows a longitudinal section through parts of a centrifuge with the housing part from FIG. 1, FIG. 5 schematically depicts another exemplary embodiment of a centrifuge with an exchangeable module, and FIG. 6 schematically depicts a longitudinal section through another exemplary embodiment of a centrifuge with an exchangeable module.

The lower shell 10 has a channel 22, which extends approximately parallel to the rotation axis 5. The channel 22 extends from the back end wall 13 into the region of the front end wall 12 and is embodied as inclined or descending toward the front (FIG. 4). On the front of the lower shell 10, an outlet opening 23 is provided, into which the channel 22 feeds. The outlet opening 23 has a connection fitting 24 to which a hose 25 can be connected. The hose 25 generally feeds into a receiving container (not shown), which receives the liquids that are centrifuged out of the reaction vessels of the reaction vessel unit 7 in the centrifuge 1. The container preferably has a ventilation opening or the hose extends through the container with a small amount of play so that liquid traveling out of the centrifuge through the hose 25 does not generate any back pressure in the container.

Figure 2:
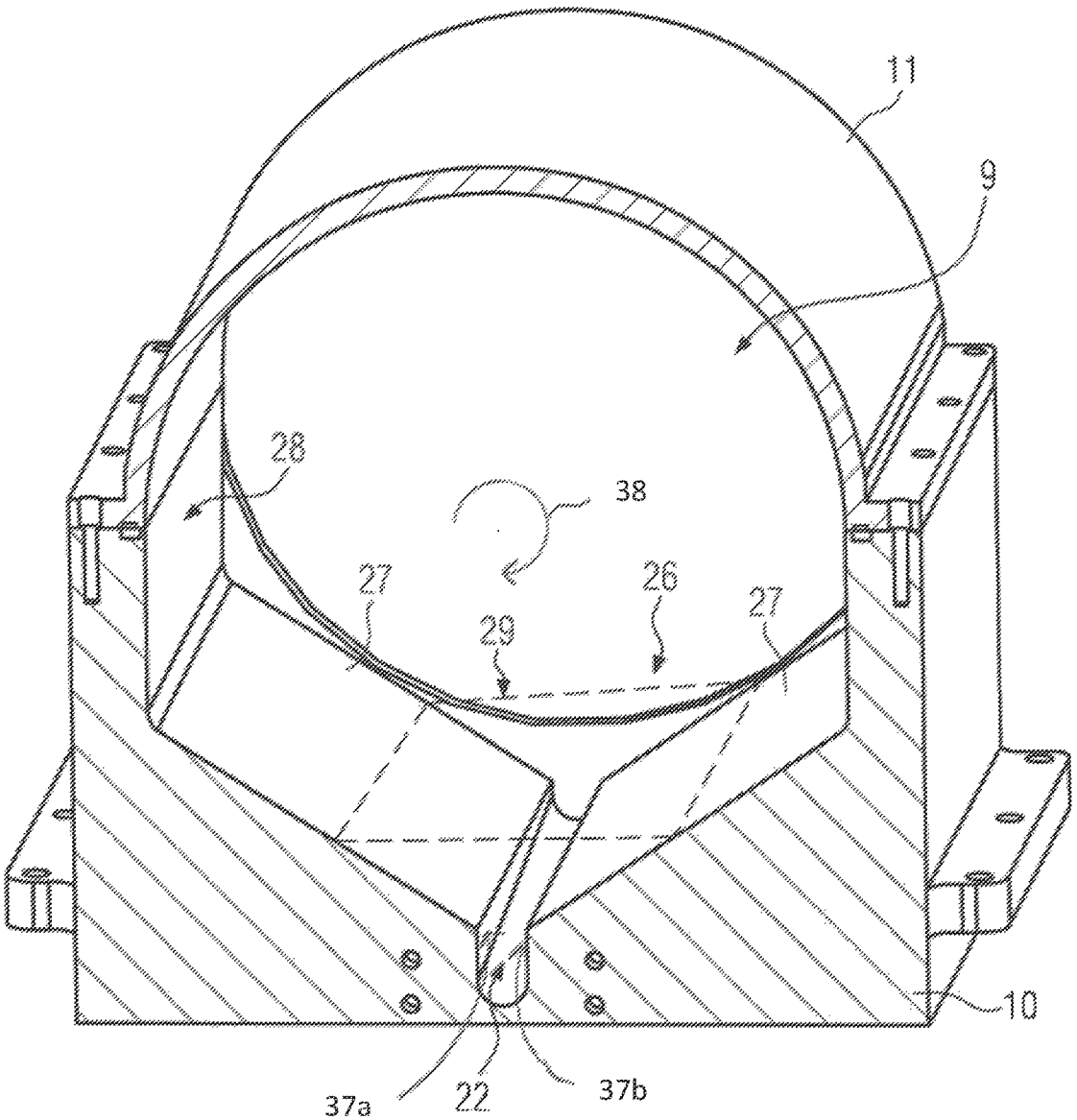
FIG. 2 shows an oblique front sectional view of the part of the housing from FIG. 1.
Figure 3:
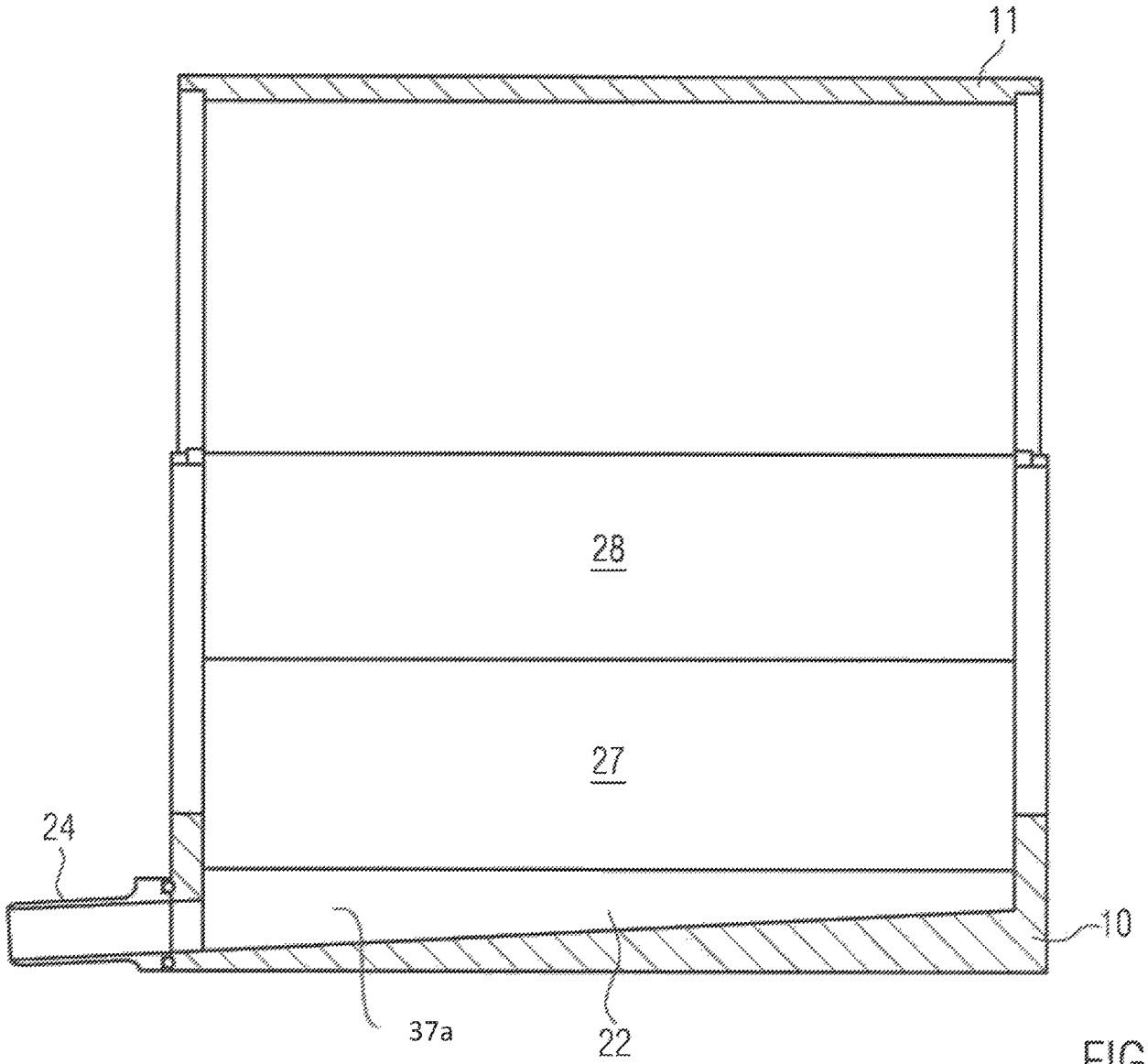
FIG. 3 shows a longitudinal section through the part of the housing from FIG. 1.

Adjacent to the channel 22, the lower shell 10 has inner surfaces, which each extend from an upper edge of the channel 22, each rising in an inclined fashion toward the outside (FIG. 2). These inner surfaces therefore form a funnel 26 and are referred to below as funnel surfaces 27. The funnel surfaces 27 are inclined at an angle of approximately 30° to 60° relative to the horizontal. Essentially, "planar" means that the funnel surfaces have a curvature radius of greater than 0.5 m and preferably greater than 1 m. In the present exemplary embodiment, the funnel surfaces 27 extend laterally in a direction beyond the region of the rotor 2, even if the latter is in its horizontal position.

From the outer edge of the funnel 26 or the funnel surfaces 27, the inner surfaces of the lower shell 10 extend upward approximately vertically. They therefore form vertical surfaces 28.

The upper shell 11 is fastened to the upper edge of the lower shell 10 and has a trough-shaped, cross-sectionally semicircular shape. The inner surface of the upper shell 11 transitions flush into the vertical surface 28. The cross-section of the housing 3 is thus not cylindrical, as is known from the prior art, instead having a cylindrical curvature only in the upper region of the shell 11, whereas the lower shell 10 tapers in a funnel shape cross-sectionally and ends at the channel 22. The channel 22 is spaced apart somewhat in the downward direction from the funnel-shaped lower shell 10 and has two approximately vertically oriented side walls 37*a*, 37*b*. The channel itself is embodied with an inclination so that a liquid contained therein drains out.

In the present exemplary embodiment, the lower shell 10 and the upper shell 11 are composed of metal. The inner surfaces of the lower shell 10 and upper shell 11 are coated with a smooth plastic layer so that liquids, which are centrifuged out of the reaction vessels of the reaction vessel units 7, drain out quickly along the inner surfaces, are conveyed by the funnel 26 to the channel 22, and from there, drain out of the rotor chamber 9. The plastic layer is composed of PTFE.

The upper edge of the channel 22 is spaced apart from the rotation axis 5 by at least 1.2 times the maximum radius of the rotor 2. This forms a free space in the funnel 26, which is not touched by the rotor 2 as it rotates. Liquid can collect in this free space. FIG. 2 shows a maximum level 29 of the liquid, which can collect in the funnel 26 without coming into contact with the rotor. It is therefore possible, with high-volume reaction vessels of a reaction vessel unit 7, to empty most of the liquid contained therein all at once and to collect it in the funnel 26 so that it can drain out gradually through the outlet opening 23.

In addition, because of the large distance of the channel 22 from the rotor and the resulting large cross-section, an air flow generated by the rotor in this region is minimal so that liquid can settle at the bottom of the funnel, i.e. in the channel 22, and drains out of the channel 22 through the outlet opening 23. Because of the low flow speed there is also a low risk of liquids, which are in the funnel-shaped region adjacent to the channel 22, being driven upward by the air flow.

Since the channel is delimited by approximately vertical side walls 37*a*, 37*b*, even when an air flow is produced in the rotation direction 38, this can no longer drive the liquid out of the channel. Once a liquid has been captured in the channel 22, it can only exit through the outlet opening 23. In the exemplary embodiment shown in FIG. 2, an air flow can strike the side wall 37*a*, which is positioned downstream in the rotation direction 38 of the rotor in the channel 22. But since the side wall 37*a* is approximately perpendicular to the flow direction, the liquid in the channel can no longer be driven back into the rotor chamber. Basically, it is sufficient for there to be a channel with an approximately vertical side wall on the side of the channel 22 positioned downstream in the rotation direction 38. For production-related reasons, however, it is advantageous to produce a channel with two approximately vertical side walls 37*a*, 37*b*.

Through this embodiment of the funnel 26 and channel 22, it is unnecessary to use a suction pump of the kind that is known form the prior art.

Figure 5:
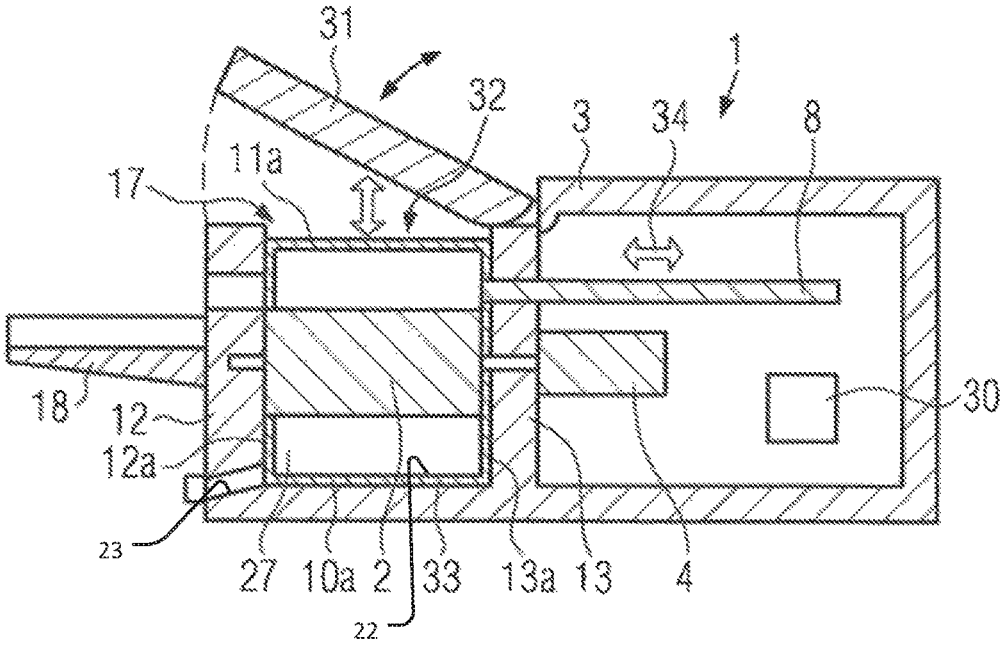

Another exemplary embodiment of a centrifuge is explained below, which is depicted in a very schematically simplified way in FIG. 5. Unless otherwise stated below, this exemplary embodiment is embodied identically to the exemplary embodiment explained above. For this reason, the same reference numerals have been used for parts that remain unchanged.

The centrifuge 1 once again has a housing 3 with a rotor 2, a drive unit 4, a ledge 18, a loading and unloading device 8, and a central control unit 30. A rotor chamber 17 is covered at the top by a pivoting cover 31. The pivoting cover 31 is connected by means of a pivot joint to the remaining part of the housing 3, specifically in the region of the back end wall 13. Once again, the rotor 2 is supported in the rotor chamber 9, but in this embodiment, it is a component of an exchangeable module 32. The exchangeable module 32 has an exchangeable module housing 33, which encloses the rotor 2 essentially completely and fits into the rotor chamber 17 of the housing 3 with a small amount of play. The exchangeable module housing 33 has a front end wall 12*a*, a back end wall 13*a*, a lower shell 10*a*, and an upper shell 11*a*. These walls 12*a*, 13*a*, or shells 10*a*, 11*a* are thin walls, which preferably constitute inner surfaces, which correspond to the shape of the inner surfaces of the rotor chamber 9 of the above-explained first exemplary embodiment.

With the cover 31 open, the exchangeable module 33 can be removed from the housing 3 in the vertical direction 34 and replaced by another exchangeable module 33 or cleaned and then reused. When opening the cover 31, the loading and unloading device 8 and the drive unit 4 are each moved slightly away from the rotor chamber 17 in the horizontal direction. This retracts the free end of the displacing rod of the loading and unloading device 8 and a shaft journal of the drive unit 4 from the rotor chamber 17 so that they are not an obstacle to a movement of the exchangeable module housing 33 in an upward direction. When the pivoting cover 31 is closed, the loading and unloading device 8 and the drive unit 4 are slid back horizontally in the direction of arrow 34.

If an exchangeable module is present in the housing 33 in the rotor chamber 17, then as a result of this, the shaft journal of the drive unit 4 is coupled to the shaft of the rotor 2 and the free end of the displacing rod into a corresponding through opening of the exchangeable module housing 33. As a result, the exchangeable module housing 33 is automatically coupled into the housing 3 and is connected to the corresponding functional parts.

At the lower edge, the exchangeable module housing 33 once again has a channel 22, which feeds into an outlet opening 23 of the housing 3.

Figure 6:
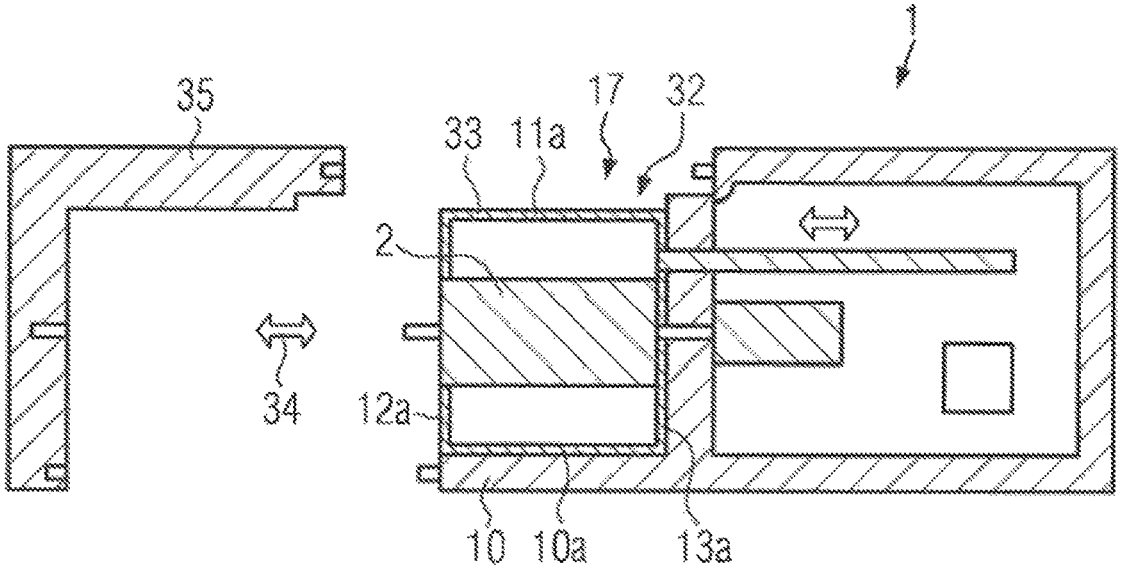

FIG. 6 has a variant of the second embodiment, which, instead of a pivotable cover 31 for limiting the rotor chamber 17, has a removable hood 35, which has the front end wall 12 and a covering wall 36 that delimits the rotor chamber 17 at the top. This hood 35 can be removed in the horizontal direction (arrow 34) so that the exchangeable module housing 33 is exposed. The exchangeable module housing 33 can be removed from the remaining part of the housing 3 in the horizontal direction (arrow 34). In this case, there is no mechanism provided for moving the drive unit 4 or the loading and unloading device 8.

When the housing 3 is open, the exchangeable module housing 33 can be exchanged or removed for cleaning and can be reinserted.

If the exchangeable module housing 33 is cleaned for example by means of autoclaving, then it is advantageous for it to be composed of heat-resistant materials such as metal. It can also be advantageous, however, to completely replace the exchangeable module after a certain amount of use. On the one hand, the reaction vessel units can be cleaned of substances that attack and for example corrode the exchangeable module 32. It is then advantageous to completely replace the exchangeable module 32 after a predetermined operating time of a few weeks to a few months. If such exchangeable modules 32 are used as consumables, then it can also be advantageous for them to be essentially composed of plastic. The exchangeable module housing 33 is preferably composed of a material with a high chemical resistance such as PTFE. The rotor is preferably composed of a hard plastic material, in particular in the form of an injection-molded part.

Both the hood 35 and the pivoting cover 31 can be fastened to the rest of the housing 3 by means of a detent or snap mechanism.

| Reference Numeral List | |
|---|---|
| 1 | centrifuge |
| 2 | rotor |
| 3 | housing |
| 4 | drive unit |
| 5 | rotation axis |
| 6 | receiving region |
| 7 | reaction vessel unit |
| 8 | loading and unloading device |
| 9 | rotor chamber |
| 10 | lower shell |
| 10a | lower shell |
| 11 | upper shell |
| 11a | upper shell |
| 12 | front end wall |
| 12a | front end wall |
| 13 | back end wall |
| 13a | back end wall |
| 14 | ball bearing |
| 15 | shaft |
| 16 | support surface |
| 17 | rotor chamber |
| 18 | ledge |
| 19 | loading and unloading opening |
| 20 | door |
| 21 | through opening |
| 22 | channel |
| 23 | outlet opening |
| 24 | connection fitting |
| 25 | hose |
| 26 | funnel |
| 27 | funnel surface |

-continued

| Reference Numeral List | |
|---|---|
| 28 | vertical surface |
| 29 | level |
| 30 | central control unit |
| 31 | pivoting cover |
| 32 | exchangeable module |
| 33 | exchangeable module housing |
| 34 | arrow |
| 35 | hood |
| 36 | covering wall |
| 37a | side wall |
| 37b | side wall |
| 38 | rotation direction |

The invention claimed is:

1. A centrifuge for cleaning a reaction vessel unit, comprising a rotor and a rotor chamber in which the rotor is positioned and supported in rotary fashion, wherein the rotor has a receiving region for receiving the reaction vessel unit and the rotor chamber is delimited by a housing having a drainage channel beneath the rotor and, adjacent to the drainage channel, the inner surfaces of the housing form a funnel that feeds into the drainage channel, wherein the drainage channel is based apart in the downward direction from a funnel-shaped lower shell, wherein the distance of the drainage channel from a rotation axis around which the rotor rotates is at least 1.1 times the radius of the rotor, the housing is comprised of a lower and an upper shell, wherein the upper shell has a cross-sectionally semicircular shape, a loading and unloading device is provided, which includes a rigid displacing rod for positioning the reaction vessel unit in the rotor or for removing the reaction vessel unit from the rotor, wherein the displacing rod is positioned in a movable fashion in such a way that it is movable between an unloading position, in which it extends through the rotor in the rotor chamber, and a loading position, in which it is retracted at least from the region of the rotor chamber that is occupied by the rotor during a rotation, and a linear drive for moving the displacing rod between the unloading position and the loading position, and the inner surface of the housing, at least in the region of the funnel and the drainage channel, is coated with a hydrophobic layer.

2. The centrifuge according to claim 1, wherein the hydrophobic layer is composed of PTFE.

3. The centrifuge according to claim 1, wherein the rotation axis of the rotor extends parallel to a support surface of the housing.

4. The centrifuge according to claim 1, wherein the drainage channel is inclined relative to a support surface of the housing.

5. The centrifuge according to claim 1, wherein the housing has a ventilation opening, which has an air filter positioned in it.

6. The centrifuge according to claim 1, wherein the drainage channel has at least one approximately vertically positioned side wall.

7. The centrifuge according to claim 1, comprising a drive unit for rotating the rotor, wherein the centrifuge has an exchangeable module that comprises the rotor and a housing section of the housing, said housing section enclosing the rotor, and the exchangeable module is embodied so that it is detachable from the other parts of the centrifuge.

8. The centrifuge according to claim 1, wherein at a free end of the displacing rod positioned in the rotor chamber, a coupling element is provided; the coupling element serves to produce a reconnectable connection of the displacing rod to the reaction vessel unit or to a supporting device for the reaction vessel unit.

9. The centrifuge according to claim 8, wherein the coupling element has a detent element, which can engage with a counterpart detent element provided on the reaction vessel unit or the supporting device, with at least the detent element or the counterpart detent element being elastically supported.

10. The centrifuge according to claim 1, wherein the displacing rod is hollow and is embodied as open at the hack end oriented away from the rotor chamber, a threaded rod is provided coaxial to the displacing rod, and the threaded rod engages in meshing fashion with a thread connected to the displacing rod so that a rotating motion of the threaded rod causes a translatory motion of the displacing rod to be executed; the threaded rod can plunge into the back end of the displacing rod.

11. The centrifuge according to claim 1, wherein a detection device for determining the position of the displacing rod in the movement direction is provided.

12. The centrifuge according to claim 1, further comprising a pipetting unit, the pipetting unit having a plurality of pipetting nozzles.

13. The centrifuge according to claim 1, further comprising an optical detection unit, the optical detection unit being embodied and positioned in such a way that adjacent to the rotor chamber, the optical detection unit is able to scan the reaction vessel unit within the reaction vessel unit's movement range.

14. The centrifuge according to claim 13, wherein the optical detection unit includes a line scan camera in order to perform a line scan of the reaction vessel unit, with a scan line being oriented approximately perpendicular to the movement direction of the reaction vessel unit.

15. The centrifuge according to claim 13, wherein the centrifuge has an evaluation device with which the signals received with the optical detection unit are automatically evaluated according to the following parameters:

color of the contents of at least one reaction vessel of the reaction vessel unit, fill level of at least one reaction vessel of the reaction vessel unit, position of the reaction vessel unit, type of reaction vessel unit.

16. The centrifuge according to claim 1, wherein the reaction vessel unit is positioned in the rotor with openings of the reaction vessels oriented radially outward, together with the reaction vessel unit, the rotor is rotated around the rotation axis so that the contents of the reaction vessels are centrifuged out and, solely due to the rotary motion of the rotor and the force of gravity, are driven into the drainage channel and from there toward the outside.

17. The centrifuge according to claim 1, wherein the reaction vessel unit is positioned in the rotor with openings of the reaction vessels oriented radially outward, the rotor is rotated together with the reaction vessel unit around the rotation axis so that the contents of the reaction vessels are centrifuged out; and alter the cleaning of one or more reaction vessel units, an exchangeable module that includes a housing section and the rotor is separated from the remaining part of the centrifuge and is either cleaned or replaced with another exchangeable module.

* * * * *